US012152527B2

(12) United States Patent
Inoue

(10) Patent No.: US 12,152,527 B2
(45) Date of Patent: Nov. 26, 2024

(54) SYSTEM FOR PERFORMING FLUSHING THROUGH COOLING WATER PATHWAY IN MARINE PROPULSION DEVICE

(71) Applicant: YAMAHA HATSUDOKI KABUSHIKI KAISHA, Iwata (JP)

(72) Inventor: Hiroshi Inoue, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 463 days.

(21) Appl. No.: 17/721,776

(22) Filed: Apr. 15, 2022

(65) Prior Publication Data

US 2023/0003164 A1 Jan. 5, 2023

(30) Foreign Application Priority Data

Jul. 5, 2021 (JP) ..... 2021-111244

(51) Int. Cl.
*F01P 3/20* (2006.01)
*B63H 20/30* (2006.01)

(52) U.S. Cl.
CPC ..... *F01P 3/205* (2013.01); *B63H 20/30* (2013.01)

(58) Field of Classification Search
CPC ..... F01P 3/202; F01P 3/205; F01P 2011/065; B63H 20/28; B63H 20/30; B63B 79/00; B63B 79/10; B63B 79/40; B63B 2203/00; B63B 2203/02
See application file for complete search history.

(56) References Cited

U.S. PATENT DOCUMENTS 9,517,495 B1 12/2016 Napurano et al.
10,344,662 B2 * 7/2019 Yin ..... F01P 5/10
11,473,487 B2 * 10/2022 Inoue ..... B63H 20/28
2020/0149460 A1 5/2020 Inoue

FOREIGN PATENT DOCUMENTS

JP 2020-078956 A 5/2020

* cited by examiner

*Primary Examiner* — Ajay Vasudeva
(74) *Attorney, Agent, or Firm* — Keating & Bennett, LLP

(57) ABSTRACT

A system for flushing a cooling water pathway in a marine propulsion device includes a water control device, an electric power control device, a data communication module, and a controller. The controller controls the water control device to supply the water from a water source to the cooling water pathway to flush the cooling water pathway. The controller controls the electric power control device to supply electric power to the marine propulsion device during the flushing. The controller determines whether to end the flushing or not. When it is determined to end the flushing, the controller controls the electric power control device to stop the supply of electric power to the marine propulsion device, and controls the data communication module to notify the end of the flushing to a terminal of a user of the marine propulsion device.

8 Claims, 2 Drawing Sheets

SYSTEM FOR PERFORMING FLUSHING THROUGH COOLING WATER PATHWAY IN MARINE PROPULSION DEVICE

CROSS REFERENCE TO RELATED APPLICATIONS

This application claims the benefit of priority to Japanese Patent Application No. 2021-111244 filed on Jul. 5, 2021. The entire contents of this application are hereby incorporated herein by reference.

BACKGROUND OF THE INVENTION

1. Field of the Invention

The present invention relates to a system for performing flushing of a cooling water pathway in a marine propulsion device.

2. Description of the Related Art

A marine propulsion device is required to perform a work called "flushing" after being used in sea water. Flushing is performed for washing out sea water with fresh water flowing through a cooling water pathway for an engine in the marine propulsion device. The engine is provided with a connection port connected to the cooling water pathway. In performing flushing, a hose extended from a water source (a water supply, a tank, etc.) is connected to the connection port.

U.S. Pat. No. 9,517,495 discloses a system for automatically performing flushing. The system disclosed in U.S. Pat. No. 9,517,495 includes a timer control unit, a start switch, and a plurality of solenoid valves. When the start switch is pushed, the timer control unit sequentially opens and closes the plurality of solenoid valves at constant time intervals. Accordingly, flushing is performed for a marine propulsion device.

Chances are that flushing is not sufficiently performed when the flushing time is short. In this case, salt contained in sea water remains in the engine, and inevitably reduces the product life of the engine. However, an appropriate time for flushing depends on factors such as the pressure of water in the water source or the status of the marine propulsion device. Therefore, it is difficult for a user to grasp an appropriate time for flushing. Because of this, when the system disclosed in U.S. Pat. No. 9,517,495 is applied to practical situations, for instance, flushing time becomes extremely long such that flushing can be sufficiently performed even at a low water pressure.

On the other hand, Japan Laid-open Patent application Publication No. 2020-78956 discloses a configuration that a controller obtains data from a marine propulsion device to determine whether to end flushing or not. Then, the controller determines whether to end flushing or not based on the obtained data. Because of this, the controller can determine appropriate timing for ending flushing. As a result, flushing can be sufficiently performed in a short time.

In the system disclosed in Japan Laid-open Patent application Publication No. 2020-78956, it is required to supply electric power to the marine propulsion device such that the controller can obtain the data from the marine propulsion device during flushing. Because of this, a user of the marine propulsion device stands by until the end of flushing, while keeping an electric power switch of the marine propulsion device turned on. After the end of flushing, the user turns off the electric power switch of the marine propulsion device, whereby electric power is stopped from being supplied to the marine propulsion device.

SUMMARY OF THE INVENTION

Preferred embodiments of the present invention provide systems by which a user is able to be informed of an end of flushing without needing to wait until the end of flushing.

According to a preferred embodiment of the present invention, a system for flushing a cooling water pathway in a marine propulsion device by water supplied from a water source includes a water control device, an electric power control device, a data communication module, and a controller. The water control device is connected to the water source and the cooling water pathway in the marine propulsion device. The water control device controls a supply of the water from the water source to the cooling water pathway. The electric power control device controls a supply of the electric power to the marine propulsion device. The data communication module is able to perform data transmission through a mobile communication network. The controller is configured or programmed to control the water control device to supply the water from the water source to the cooling water pathway so as to perform the flushing. The controller is configured or programmed to control the electric power control device to supply the electric power to the marine propulsion device during the flushing. The controller determines whether to end the flushing or not. When it is determined to end the flushing, the controller is configured or programmed to control the electric power control device to stop the supply of the electric power to the marine propulsion device, and control the data communication module to notify a terminal of a user of the marine propulsion device of the end of the flushing.

In a system according to a preferred embodiment of the present invention, the controller is configured or programmed to determine whether to end the flushing or not. When it is determined to end the flushing, the controller is configured or programmed to then stop the supply of the electric power to the marine propulsion device. Because of this, the user is not required to wait until the end of the flushing and is able to go home at the onset of the flushing. When it is determined to end the flushing, the controller notifies the terminal of the user of the marine propulsion device of the end of the flushing. Accordingly, even if the user is away from the marine propulsion device before the end of the flushing, the user is able to be informed of the end of the flushing.

The above and other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
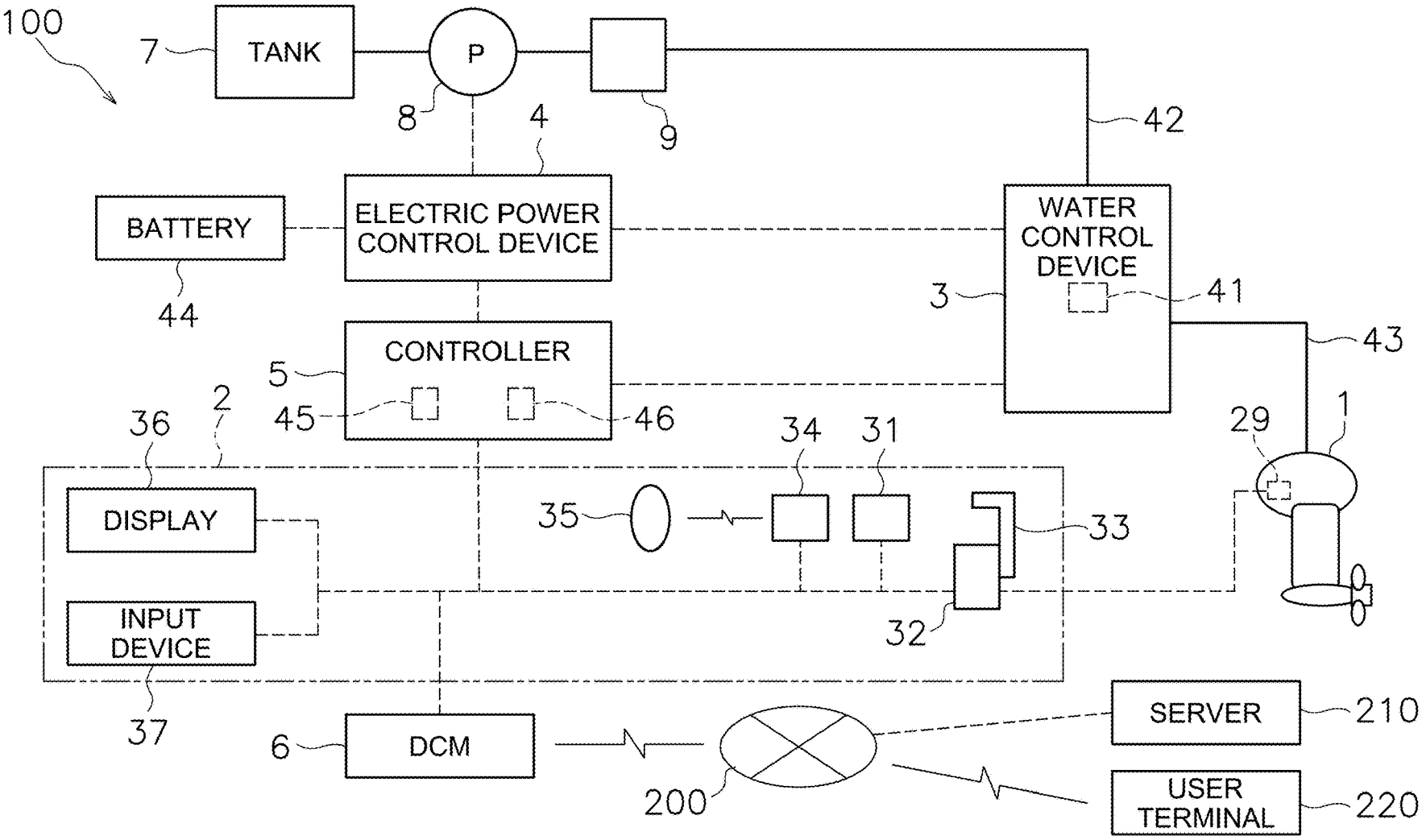
FIG. 1 is a schematic diagram showing a system according to a preferred embodiment of the present invention.

Preferred embodiments of the present invention will be hereinafter explained with reference to drawings. FIG. 1 is a schematic diagram showing a system 100 according to a preferred embodiment of the present invention. The system 100 controls a marine propulsion device 1. The system 100 performs flushing of a cooling water pathway in the marine propulsion device 1 with water supplied from a water source. In the present preferred embodiment, the marine propulsion device 1 is an outboard motor, for example. The system 100 may be configured to perform flushing of a plurality of marine propulsion devices.

Figure 2:
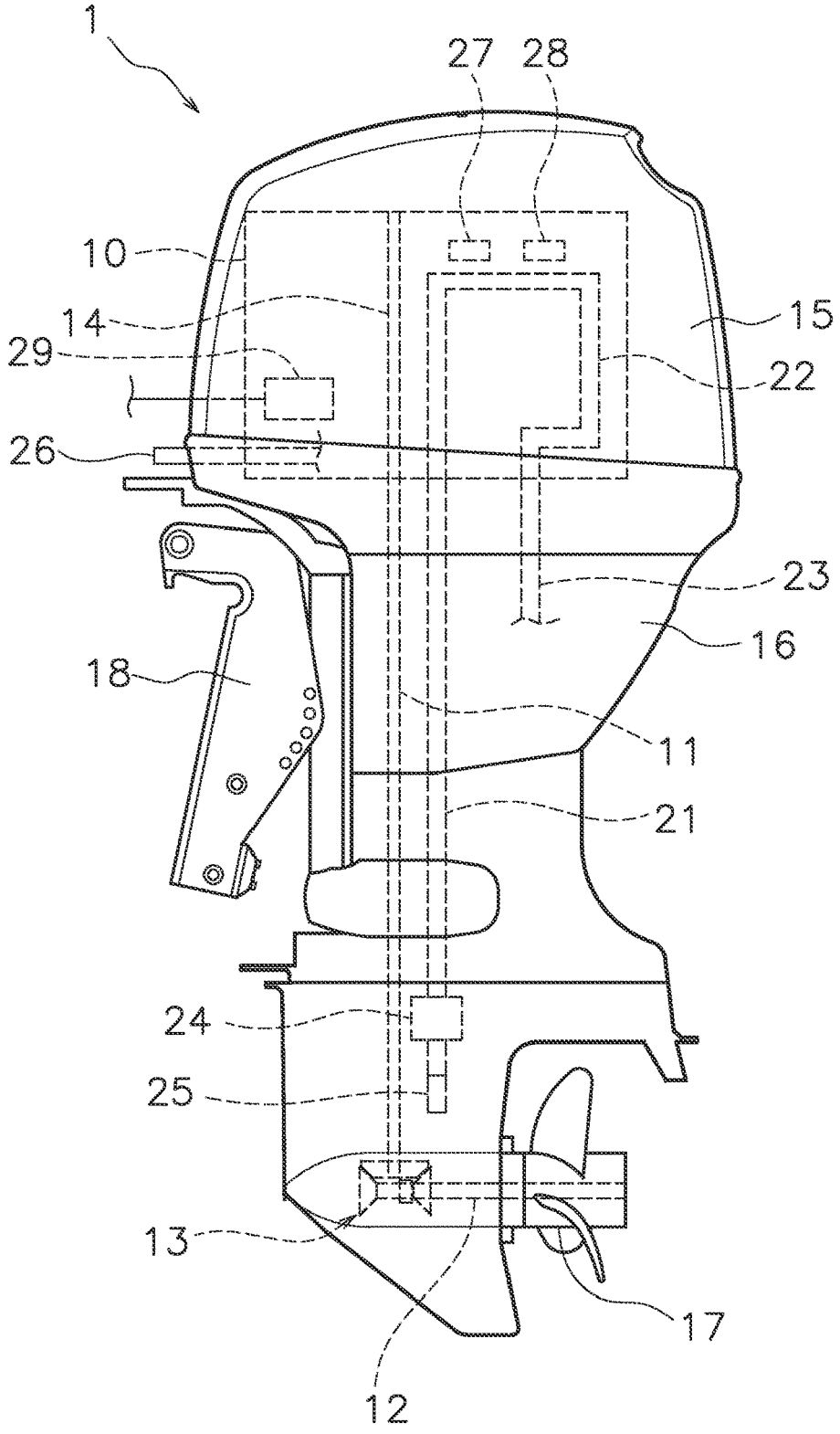
FIG. 2 is a side view of a marine propulsion device according to a preferred embodiment of the present invention.

FIG. 2 is a side view of the marine propulsion device 1. As shown in FIG. 2, the marine propulsion device 1 includes an engine 10, a drive shaft 11, a propeller shaft 12, and a shift mechanism 13. The engine 10 generates a thrust to propel a watercraft. The engine 10 includes a crankshaft 14. The crankshaft 14 extends in the vertical direction. The drive shaft 11 is connected to the crankshaft 14. The drive shaft 11 extends in the vertical direction. The drive shaft 11 extends downward from the engine 10.

The propeller shaft 12 extends in the back-and-forth direction of the marine propulsion device 1. The propeller shaft 12 is connected to the drive shaft 11 through the shift mechanism 13. A propeller 17 is connected to the propeller shaft 12. The shift mechanism 13 switches the rotational direction of mechanical power to be transmitted from the drive shaft 11 to the propeller shaft 12. The shift mechanism 13 includes, for instance, a plurality of gears and a clutch that changes the meshing of the gears.

The marine propulsion device 1 includes a cowl 15 and a housing 16. The cowl 15 accommodates the engine 10. The housing 16 is located below the cowl 15. The housing 16 accommodates the drive shaft 11 and the propeller shaft 12. The marine propulsion device 1 includes a bracket 18. The marine propulsion device 1 is attached to the watercraft through the bracket 18.

The marine propulsion device 1 includes a supply water pathway 21, a cooling water pathway 22, a discharge water pathway 23, and a water pump 24. It should be noted that FIG. 2 schematically shows the respective water pathways 21 to 23. The supply water pathway 21 is located in the housing 16. The supply water pathway 21 is connected to an inlet 25 provided in the housing 16. The water pump 24 is connected to the supply water pathway 21. The water pump 24 sucks water through the inlet 25 and supplies the water to the supply water pathway 21.

The cooling water pathway 22 is provided in the engine 10. The cooling water pathway 22 may be provided in devices such as an exhaust pipe or an oil cooler located around or near the engine 10. The cooling water pathway 22 is connected to the supply water pathway 21. The engine 10 is cooled by water flowing through the cooling water pathway 22. The discharge water pathway 23 is located in the housing 16. The discharge water pathway 23 is connected to an outlet (not shown in the drawings) provided in the housing 16. The water, flowing through the cooling water pathway 22, is discharged to the outside of the marine propulsion device 1 through the discharge water pathway 23. The marine propulsion device 1 includes a connecting port 26 to perform the flushing. The connecting port 26 is connected to the cooling water pathway 22.

The marine propulsion device 1 includes a water pressure sensor 27 and a salt concentration sensor 28. The water pressure sensor 27 detects the pressure of water in the cooling water pathway 22. The water pressure sensor 27 outputs a signal indicating the pressure of water in the cooling water pathway 22. The salt concentration sensor 28 detects the concentration of salt in the water in the cooling water pathway 22. The salt concentration sensor 28 outputs a signal indicating the concentration of salt in the water in the cooling water pathway 22. The salt concentration sensor 28 may include, for instance, an electrical conductivity sensor. However, the salt concentration sensor 28 may be another type of sensor.

The marine propulsion device 1 includes an ECU (Engine Control Unit) 29. The ECU 29 electrically controls the engine 10. The ECU 29 includes a processor such as a CPU (Central Processing Unit) and memories such as a RAM (Random Access Memory) and a ROM (Read Only Memory). The ECU 29 is connected to the water pressure sensor 27 and the salt concentration sensor 28 in a communicable manner. The ECU 29 receives signals transmitted thereto from the sensors 27 and 28.

As shown in FIG. 1, the system 100 includes a watercraft operating system 2. The watercraft operating system 2 is located in, for instance, a cockpit of the watercraft to which the marine propulsion device 1 is mounted. The watercraft operating system 2 is connected to the ECU 29 in a communicable manner. The watercraft operating system 2 includes an engine switch 31 and a throttle shift operating device 32. The ECU 29 starts the engine 10 in response to a signal outputted thereto from the engine switch 31. The ECU 29 stops the engine 10 in response to a signal outputted thereto from the engine switch 31.

The throttle shift operating device 32 includes a throttle lever 33. The throttle lever 33 is operable from a neutral position to a forward moving position and a rearward moving position. The throttle shift operating device 32 outputs a signal indicating the operating position of the throttle lever 33. The ECU 29 receives the signal from the throttle shift operating device 32. The ECU 29 controls the shift mechanism 13 in accordance with the operating position of the throttle lever 33. Accordingly, the rotation of the propeller shaft 12 is switched between a forward moving direction and a rearward moving direction. The ECU 29 controls the rotational speed of the engine 10 in accordance with the operating position of the throttle lever 33.

The watercraft operating system 2 includes an immobilizer control module 34. The immobilizer control module 34 communicates with an immobilizer key 35 in a wireless manner. The immobilizer control module 34 receives a signal containing an ID code from the immobilizer key 35. When the ID code outputted from the immobilizer key 35 satisfies a predetermined condition, the immobilizer control module 34 allows starting of the engine 10. For example, when the ID code outputted from the immobilizer key 35 is matched with a true code assigned to the marine propulsion device 1, the immobilizer control module 34 transmits a signal to allow starting of the engine 10 to the ECU 29. When the engine switch 31 is operated while starting of the engine 10 is allowed, the ECU 29 starts the engine 10.

However, when starting of the engine 10 is not allowed, the ECU 29 does not start the engine 10 even if the engine switch 31 is operated. It should be noted that when the ID code outputted from the immobilizer key 35 is not matched with the true code assigned to the marine propulsion device 1, the immobilizer control module 34 may lock transmission of the signal from the engine switch 31 to the ECU 29.

The watercraft operating system 2 includes a display 36 and an input device 37. The display 36 includes, for instance, an LCD (Liquid Crystal Display). However, the display 36 may be another type of display device such as an organic EL display. The display 36 displays information regarding the marine propulsion device 1. The input device 37 receives an operational input from a user. The input device 37 outputs a signal indicating the operational input by the user. The input device 37 includes, for instance, a touchscreen. However, the input device 37 may be a device including at least one hardware key.

The system 100 includes a water control device 3, an electric power control device 4, a controller 5, and a data communication module (hereinafter referred to as DCM) 6. The water control device 3 is connected to a tank 7 provided as a water source. The tank 7 stores fresh water. The water control device 3 controls the supply of water from the tank 7 to the cooling water pathway 22. The water control device 3 is connected to the tank 7 through a pump 8 and an accumulator 9. The water control device 3 is connected to the cooling water pathway 22 in the marine propulsion device 1.

The water control device 3 includes a valve 41. A hose 42, extending from the tank 7, is connected to the water control device 3. A hose 43, extending from the marine propulsion device 1, is connected to the water control device 3. The hose 43 is connected to the connecting port 26 to flush the marine propulsion device 1. When the valve 41 is opened, the water is supplied from the tank 7 to the cooling water pathway 22 in the marine propulsion device 1. When the valve 41 is closed, the water is not supplied from the tank 7 to the cooling water pathway 22 in the marine propulsion device 1. The valve 41 may be a solenoid valve that is opened and closed in response to a command signal transmitted thereto from the controller 5.

The electric power control device 4 is connected to a battery 44. The electric power control device 4 includes a battery management system. The electric power control device 4 controls the supply of electric power to the system 100. The electric power control device 4 is electrically connected to the marine propulsion device 1 and the watercraft operating system 2. The electric power control device 4 controls the supply of electric power to the marine propulsion device 1 and the watercraft operating system 2.

The electric power control device 4 is electrically connected to the water control device 3 and the pump 8. The electric power control device 4 controls the supply of electric power to the water control device 3 and the pump 8. The electric power control device 4 detects the remaining amount of electric power in the battery 44. The electric power control device 4 monitors the electric power consumed by devices or machines included in the system 100.

The DCM 6 is able to perform data transmission through a mobile communication network 200. The mobile communication network 200 may be, for instance, a network of a 3G, 4G, or 5G mobile communication system. The DCM 6 is communicable with a server 210. The DCM 6 is communicable with a user terminal 220. The user terminal 220 may be, for instance, a smartphone, a tablet, or a personal computer. It should be noted that the DCM 6 may be communicable with the user terminal 220 through the server 210.

The controller 5 is configured or programmed to control the water control device 3, the electric power control device 4, and the DCM 6. The controller 5 is connected to the ECU 29, the water control device 3, and the electric power control device 4 in a communicable manner. The controller 5 obtains propulsion device data of the marine propulsion device 1 from the ECU 29. The propulsion device data indicates a status of the marine propulsion device 1. The propulsion device data contains the concentration of salt in the cooling water pathway 22. The propulsion device data may contain other data such as the pressure of water in the cooling water pathway 22.

The controller 5 includes a processor 45 and a storage device 46. The storage device 46 stores programs and data to perform the flushing. The storage device 46 includes memories such as a RAM and a ROM. The storage device 46 may include an auxiliary storage device such as an HDD (Hard Disk Drive) or an SSD (Solid State Drive). The processor 45 executes a process to flush the cooling water pathway 22 based on the programs and data.

The display 36 and the input device 37 are connected to the controller 5 in a communicable manner. The controller 5 starts flushing when an operation to start flushing is performed in the input device 37. The display 36 shows information indicating a status of flushing in accordance with a command signal transmitted thereto from the controller 5.

During flushing, the pump 8 is driven such that the water in the tank 7 is supplied to the water control device 3 by the pump 8. The controller 5 controls the water control device 3 to supply the water from the tank 7 to the cooling water pathway 22 in the marine propulsion device 1. Then, the water is discharged from the cooling water pathway 22 through the discharge water pathway 23 to the outside of the marine propulsion device 1. In this manner, flushing of the cooling water pathway 22 is performed.

During flushing, the engine 10 is stopped. Unless the ID code outputted from the immobilizer key 35 satisfies the predetermined condition, the immobilizer control module 34 prohibits starting of the engine 10 during flushing. Therefore, when the ID code outputted from the immobilizer key 35 does not satisfy the predetermined condition, the engine 10 is not started even if the engine switch 31 is operated during flushing.

However, during flushing, the controller 5 controls the electric power control device 4 to supply electric power to the marine propulsion device 1. During flushing, the ECU 29 transmits the propulsion device data to the controller 5. The controller 5 determines whether to end flushing or not based on the propulsion device data. For example, the controller 5 determines to end flushing when the concentration of salt in the cooling water pathway 22 becomes a predetermined threshold or less.

The controller 5 may determine to end flushing when it is determined that an occurrence of a malfunction occurs in the marine propulsion device 1 based on the propulsion device data. For example, the controller 5 may determine to end flushing when the pressure of water in the cooling water pathway 22 is an abnormal value. The controller 5 may determine to end flushing when the concentration of salt in the cooling water pathway 22 does not become the predetermined threshold or less even at or after the elapse of a predetermined time since the start of flushing.

When it is determined to end flushing, the controller 5 controls the water control device 3 to stop the supply of water to the cooling water pathway 22 in the marine propulsion device 1. The controller 5 controls the electric power control device 4 to stop the supply of electric power to the pump 8. The pump 8 is thus stopped. When it is determined to end flushing, the controller 5 controls the electric power control device 4 to stop the supply of electric power to the watercraft operating system 2. The marine propulsion device 1 is thus powered off.

When flushing ends, the controller 5 controls the DCM 6 to notify the terminal 220 of the user of the marine propulsion device 1 of the end of flushing. The end of the flushing may be notified by, for instance, transmission of an e-mail or a short message. The end of flushing may be notified as a notification command to an application or software installed in the user terminal 220.

The controller 5 may determine whether flushing has ended normally or abnormally. When flushing has ended normally, the controller 5 may notify the user terminal 220 of the normal ending of flushing. When flushing has ended abnormally, the controller 5 may notify the user terminal 220 of the abnormal ending of flushing.

The controller 5 records a history of flushing performed in the marine propulsion device 1 in the storage device 46. The history of flushing contains, for instance, date and time when flushing has been performed. The history of flushing may contain whether flushing has ended normally or abnormally. The history of flushing may contain clock time when the engine has stopped. The controller 5 may send the history of flushing performed in the marine propulsion device 1 to the server 210 to store the sent history therein. The controller 5 may send the history of flushing performed in the marine propulsion device 1 to the user terminal 220.

In the system 100 according to the preferred embodiments explained above, the controller 5 determines whether to end flushing or not. Then, when it is determined to end flushing, the controller 5 stops the supply of electric power to the marine propulsion device 1. Because of this, the user is not required to wait until the ending of flushing and is able to go home at the onset of flushing. When it is determined to end flushing, the controller 5 notifies the terminal 220 of the user of the marine propulsion device 1 of the end of flushing. Accordingly, even the user is if away from the marine propulsion device 1 before the end of flushing, the user is able to be informed of the end of flushing.

Preferred embodiments of the present invention have been explained above. However, the present invention is not limited to the preferred embodiments described above, and a variety of changes can be made without departing from the gist of the present invention.

The marine propulsion device 1 is not limited to the outboard motor, and alternatively, may be another type of marine propulsion device such as an inboard motor. The number of marine propulsion devices is not limited to one, and alternatively, may be greater than one. The configuration of the marine propulsion device 1 is not limited to that in the preferred embodiments described above and may be changed. The configuration of the system 100 is not limited to that in the preferred embodiments described above and may be changed. For example, the water source is not limited to the tank 7, and alternatively, may be a water supply.

The configuration of the controller 5 is not limited to that in the preferred embodiments described above and may be changed. The controller 5 may be integral with the water control device 3. The controller 5 may be integral with the display 36 and/or the input device 37. The controller 5 may be the ECU 29. In other words, the ECU 29 may execute the processes executed by the controller 5 described above.

The end of flushing may be determined not only based on the concentration of salt in the cooling water pathway 22 but also based on other data. For example, the controller 5 may count an elapsed time from the start of flushing. When the elapsed time reaches a predetermined threshold, the controller 5 may determine to end flushing.

The storage device 46 for recording the history of flushing is not limited to the storage device provided in the controller 5, and alternatively, may be a storage device provided in another device. For example, the history of flushing may be recorded in a storage device provided in the input device 37.

The DCM 6 may receive a command to start flushing from the user terminal 220. When the DCM 6 receives the command to start flushing, the controller 5 may control the water control device 3 to start flushing. This configuration enables the user to operate the start of flushing from a remote location.

When it is determined to end flushing, the controller 5 may determine whether consumption of electric power for any purpose other than flushing has been detected or not. When the consumption of electric power for any purpose other than flushing has been detected, the controller 5 may control the electric power control device 4 to stop the supply of electric power to the marine propulsion device 1 after the consumption of electric power ends. For example, during system updating of the ECU 29, electric power is kept supplied to the ECU 28 even if flushing ends. When the system updating is then completed, the controller 5 stops the supply of electric power to the marine propulsion device 1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A system for flushing a cooling water pathway in a marine propulsion device with water supplied from a water source, the system comprising:

a water control device connected to the water source and the cooling water pathway in the marine propulsion device so as to control a supply of water from the water source to the cooling water pathway;

an electric power control device to control a supply of electric power to the marine propulsion device;

a data communication module to perform data transmission through a mobile communication network; and a controller configured or programmed to:

control the water control device to supply the water from the water source to the cooling water pathway to perform the flushing;

control the electric power control device to supply the electric power to the marine propulsion device during the flushing;

determine whether to end the flushing or not; and when it is determined to end the flushing, control the electric power control device to stop the supply of the electric power to the marine propulsion device, and control the data communication module to notify a terminal of a user of the marine propulsion device of the end of the flushing.

2. The system according to claim 1, wherein the controller is configured or programmed to:

determine whether the end of the flushing is normal or not; and notify the terminal of the user when the end of the flushing is normal.

3. The system according to claim 1, wherein the controller is configured or programmed to:

determine whether the end of the flushing is abnormal or not; and notify the terminal of the user when the end of the flushing is abnormal.

4. The system according to claim 1, wherein the data communication module is able to receive a command to start the flushing from the terminal of the user; and the controller is configured or programmed to control the water control device to start the flushing when the data communication module has received the command to start the flushing.

5. The system according to claim 1, wherein the electric power control device is able to detect consumption of the electric power for a purpose other than the flushing; and the controller is configured or programmed to, when it is determined to end the flushing and if the consumption of the electric power for the purpose other than the flushing has been detected, control the electric power control device to stop the supply of the electric power to the marine propulsion device after the consumption of the electric power ends.

6. The system according to claim 1, further comprising:

an immobilizer control module to receive a signal containing an ID code from an immobilizer key, and allow an engine of the marine propulsion device to start when the ID code from the immobilizer key satisfies a predetermined condition; wherein the immobilizer control module prohibits the engine from starting unless the ID code from the immobilizer key satisfies the predetermined condition during the flushing.

7. The system according to claim 1, further comprising:

a storage to record a history of the flushing performed in the marine propulsion device.

8. The system according to claim 1, wherein the data communication module is communicable with a server; and the controller is configured or programmed to send a history of the flushing performed in the marine propulsion device to the server so as to store the history in the server.

* * * * *